US007284284B2

(12) United States Patent
Wysopal

(10) Patent No.: US 7,284,284 B2
(45) Date of Patent: Oct. 23, 2007

(54) HEADGEAR ARTICLE INCORPORATING A BOTTLE OPENER

(76) Inventor: James Wysopal, 2239 Aralia St., Newport Beach, CA (US) 92660

( * ) Notice: Subject to any disclaimer, the term of this patent is extended or adjusted under 35 U.S.C. 154(b) by 85 days.

(21) Appl. No.: 11/324,590

(22) Filed: Jan. 3, 2006

(65) Prior Publication Data

US 2006/0117462 A1 Jun. 8, 2006

Related U.S. Application Data

(63) Continuation-in-part of application No. 10/957,985, filed on Oct. 4, 2004, now abandoned, and a continuation-in-part of application No. 29/207,574, filed on Jun. 15, 2004, now Pat. No. Des. 503,516.

(51) Int. Cl.
*A42B 1/24* (2006.01)

(52) U.S. Cl. ..... 2/209.13; 2/195.1

(58) Field of Classification Search ..... D8/38, D8/35; 215/228; 2/209.13, 175.1; 273/DIG. 17; 434/399; 446/27; 43/57.1; 81/3.4, 3.07; 24/3.1

See application file for complete search history.

(56) References Cited

U.S. PATENT DOCUMENTS

| | | | | | |
|---|---|---|---|---|---|
| 5,133,233 | A | | 7/1992 | Erwin | |
| D363,157 | S | * | 10/1995 | Rodgers | D2/866 |
| 5,487,191 | A | * | 1/1996 | Ridley | 2/195.1 |
| D383,045 | S | * | 9/1997 | Turso | D8/38 |
| D390,433 | S | * | 2/1998 | Miller | D8/38 |
| 5,742,944 | A | | 4/1998 | Pfefferman | |
| D406,505 | S | | 3/1999 | Arroyo et al. | |
| D406,995 | S | | 3/1999 | Petersen et al. | |
| 5,920,913 | A | | 7/1999 | Brandon et al. | |
| D504,290 | S | * | 4/2005 | Lockhart | D8/38 |

* cited by examiner

*Primary Examiner*—Katherine Moran
*Assistant Examiner*—Sally Colson Cline
(74) *Attorney, Agent, or Firm*—Eric Karich

(57) ABSTRACT

A headgear article is disclosed including a head-engaging portion, a brim attached to the head-engaging portion, and a bottle opener forming a portion of either the head-engaging portion or the brim.

2 Claims, 5 Drawing Sheets

HEADGEAR ARTICLE INCORPORATING A BOTTLE OPENER

CROSS-REFERENCE TO RELATED APPLICATIONS

This application for a utility patent is a continuation-in-part of a previously filed utility patent, still pending, having application Ser. No. 10/957,985, filed Oct. 4, 2004 now abandoned. This application is also a continuation-in-part of a previously filed design patent having the application Ser. No. 29/207,574, filed Jun. 15, 2004, now patent number D503,516, registered Apr. 5, 2005, and also of design patent application Nos. 29/241,554 and 29/241,518, both filed Oct. 28, 2005.

BACKGROUND OF THE INVENTION

1. Field of the Invention

This invention relates generally to headgear articles, and more particularly to a headgear articles incorporating an integral bottle opener.

2. Description of Related Art

Headgear articles such as hats are widely worn outdoors to protect wearers' eyes and/or heads from solar radiation and rain. A typical hat may include a top head covering portion called a "crown" and projecting edge called a "brim." A cap is a well-known type of hat with a close-fitting crown and a partial brim called a "visor."

The present invention includes the combination of a headgear article such as a baseball cap that includes an integral bottle opener.

SUMMARY OF THE INVENTION

A headgear article is disclosed including a head-engaging portion, a brim attached to the head-engaging portion, and a bottle opener forming a portion of either the head-engaging portion or the brim.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
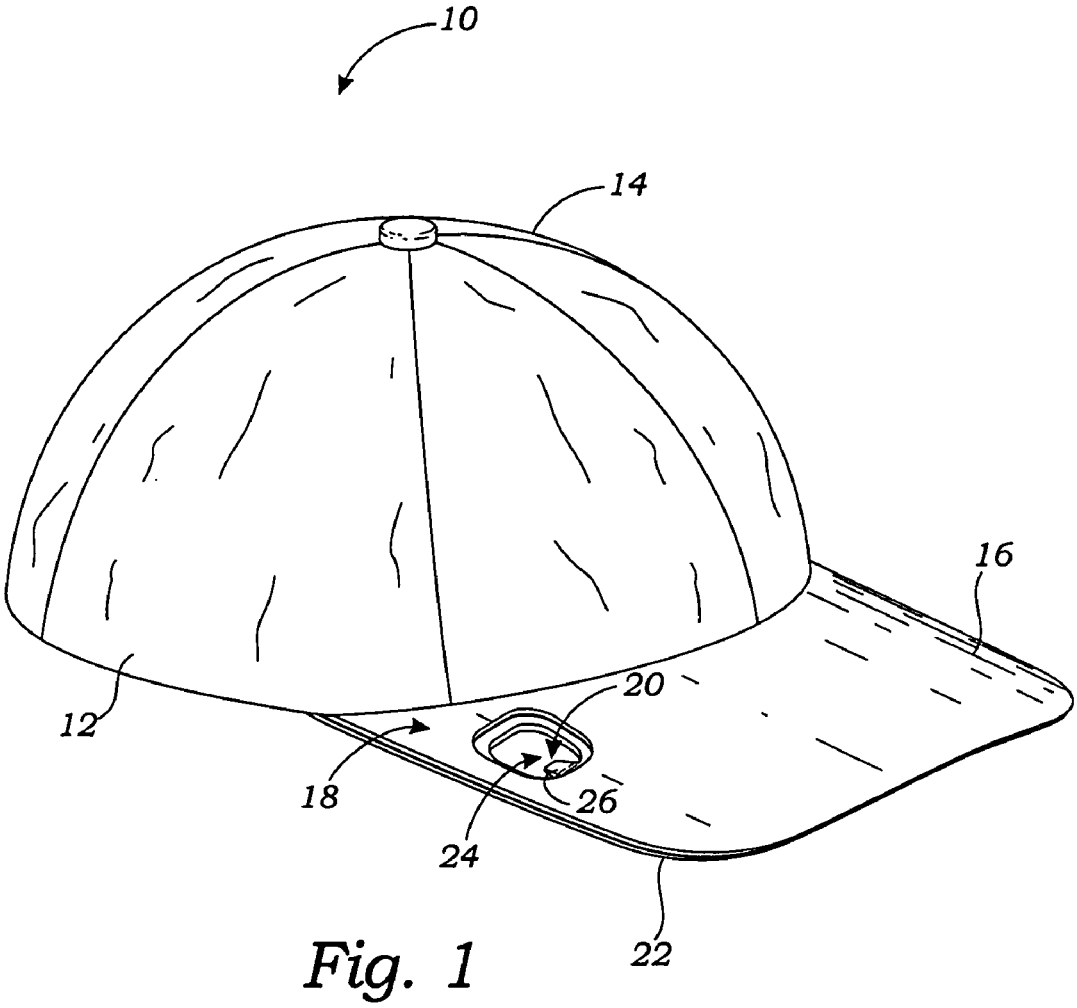
FIG. 1 is a perspective view of one embodiment of a headgear article including a head-engaging portion, a crown, and a brim, wherein a bottle opener is positioned in an opening on a right side of the brim.

FIG. 1 is a perspective view of one embodiment of a headgear article 10 including a head-engaging portion 12, a crown 14, and a brim 16. The crown 14 and the brim 16 are attached to the head-engaging portion 12 and a bottle opener 18 is positioned in an opening 20 on a right side of the brim 16. The headgear article 10 is adapted to be positioned on a head of a user, as is well known in the art. While one particular type of headgear article 10 is illustrated, other types of headgear, including visors (without the crown 14), fishing caps, poker headgear, and other forms of headgear, should be considered within the scope of the claimed invention.

In the embodiment of FIG. 1, the headgear article 10 is a cap and the brim 16 is a partial brim or visor projecting from a front edge of the cap. In other embodiments, the headgear article 10 may be, for example, a hat, or a "shade visor" without the crown 14. For clarity and ease of understanding, herein below the headgear article 10 will be referred to as cap 10, and the brim 16 will be referred to as visor 16.

In the embodiment of FIG. 1, head-engaging portion 12 is a band adapted to encircle a head of a wearer. As indicated in FIG. 1, the crown 14 covers the head-engaging portion 12. The head-engaging portion 12 is preferably lined with a soft material (e.g., soft cloth) for wearer comfort. The soft material also preferably readily absorbs moisture (e.g., sweat). In other embodiments, the head-engaging portion 12 may be, for example, a pair of arms adapted to engage and grasp opposite sides of the head of the wearer, thus holding the cap 10 in place.

In the embodiment of FIG. 1, the bottle opener 18 is integrated into the visor 16, and the wearer removes the cap 10 from his or her head to use the bottle opener 18. In other embodiments, the bottle opener 18 may form an integral portion of the head-engaging portion 12. Further, in other embodiments the bottle opener 18 may be detachable from the visor 16 (or from the head-engaging portion 12) such that the wearer need not remove the cap 10 from his or her head to use the bottle opener 18.

In the embodiment of FIG. 1, the bottle opener 18 is formed in a sheet of a substantially rigid material 22. The sheet of material 22 advantageously forms an underside layer of the visor 16, and helps to maintain a desired shape (e.g., curvature) the visor 16. The bottle opener 18 has an aperture 24 positioned in the opening 20 of the visor 16. The aperture 24 is dimensioned to receive a portion of a bottle cap (not shown) covering an opening in a neck of a bottle. The bottle opener 18 also includes a projection 26 extending into the aperture 24. The projection 26 is preferably a rigid tab that extends partially into the aperture 24 and is adapted for engaging a rim of the bottle cap (not shown), for removing the bottle cap from a bottle.

It is noted that the bottle opener 18 may form a portion of the visor 16 in other ways. For example, the sheet of material 22 may be smaller than the visor 16, and may be attached to or within the visor 16 such that the aperture 24 is positioned within the opening 20 of the visor 16.

Figure 2:
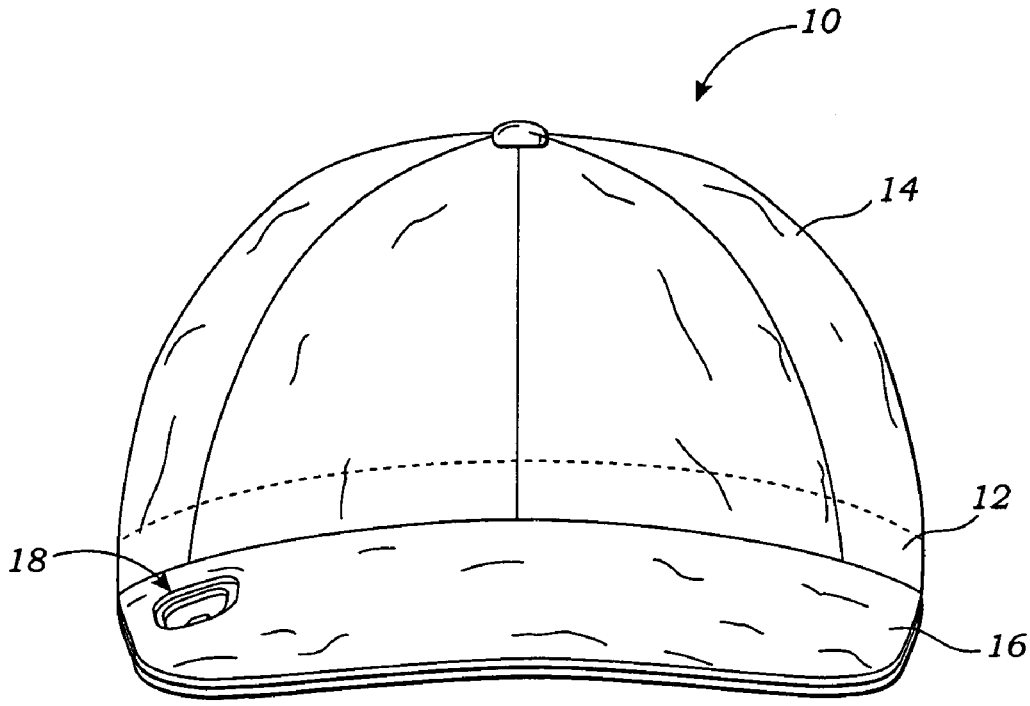
FIG. 2 is a front elevation view of the headgear article of FIG. 1.
Figure 3:
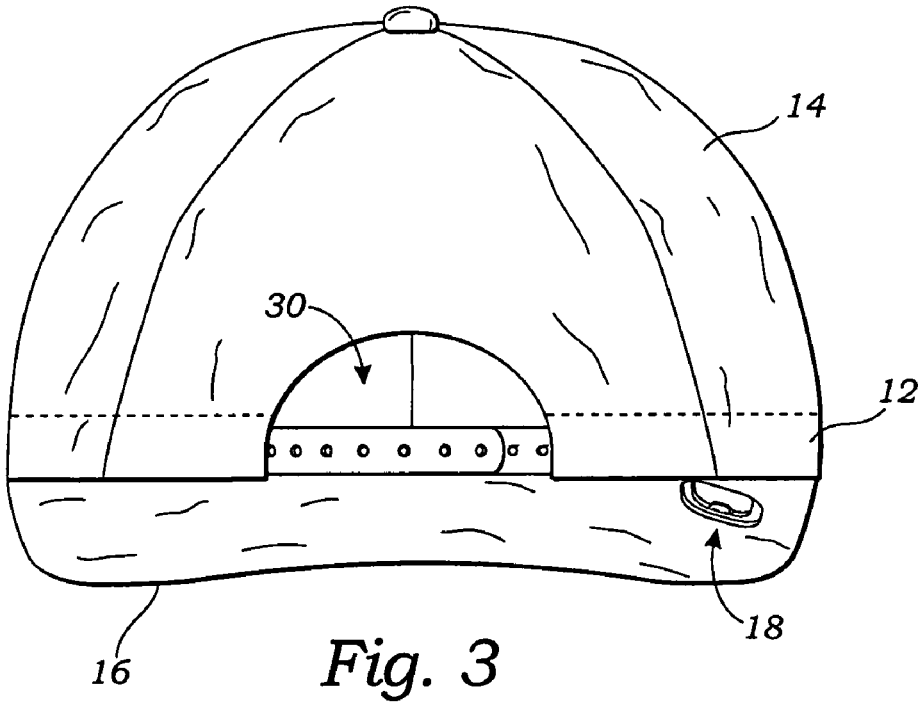
FIG. 3 is a back elevation view of the headgear article of FIG. 1.

FIG. 2 is a front elevation view of the cap 10 of FIG. 1, and FIG. 3 is a back elevation view of the cap 10 of FIG. 1.

Visible in FIG. 3 is a size adjustment mechanism 30 that forms a part of the head-engaging portion 12. The size adjustment mechanism 30 is used to adjust a circumference of the head-engaging portion 12. In the embodiment of FIG. 3, the size adjustment mechanism 30 is the well known overlapping plastic strap system. One of the plastic straps has tabs spaced apart by a distance, and the other plastic strap has holes spaced apart by the same distance. Inserting the tabs into different holes varies the circumference of the head-engaging portion 12.

It is noted that other known size adjustment mechanisms may also be used, including size adjustment mechanisms with elastic straps, hook-and-loop fasteners, buckles, etc.

Figure 4:
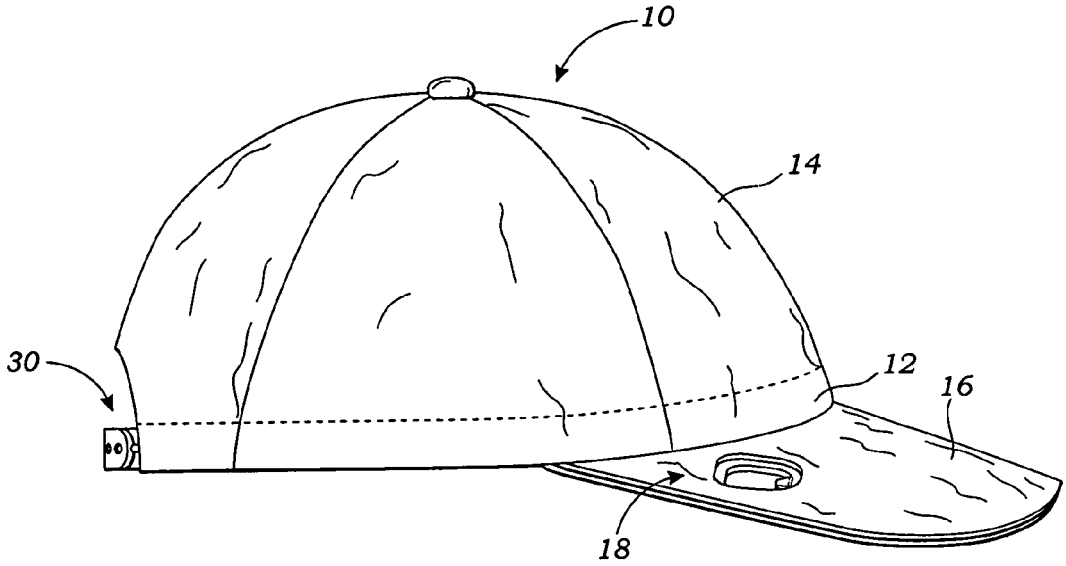
FIG. 4 is a right side elevation view of the headgear article of FIG. 1.
Figure 5:
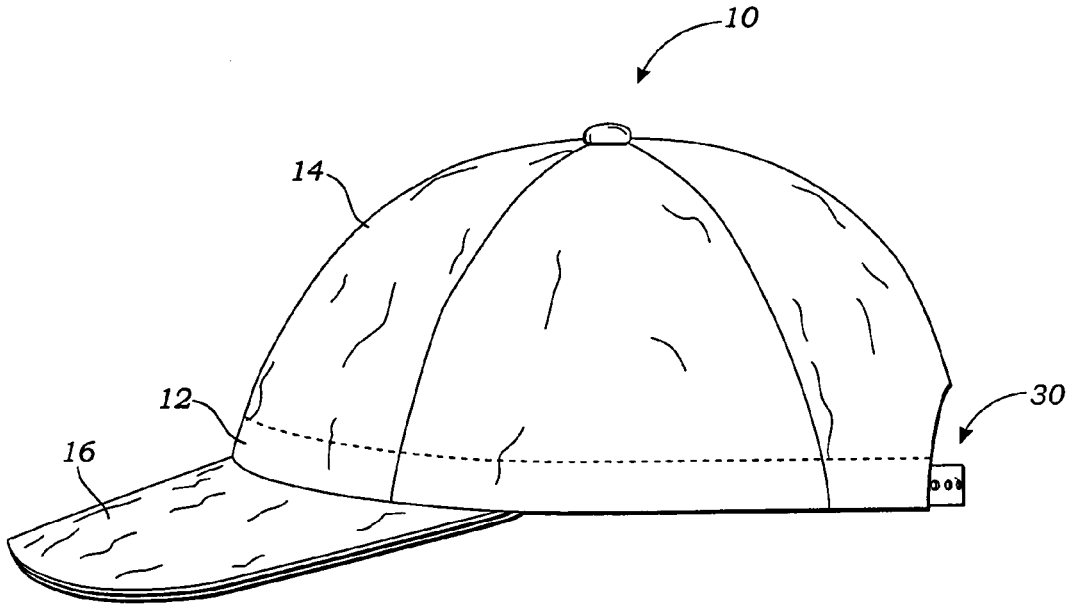
FIG. 5 is a left side elevation view of the headgear article of FIG. 1.
Figure 6:
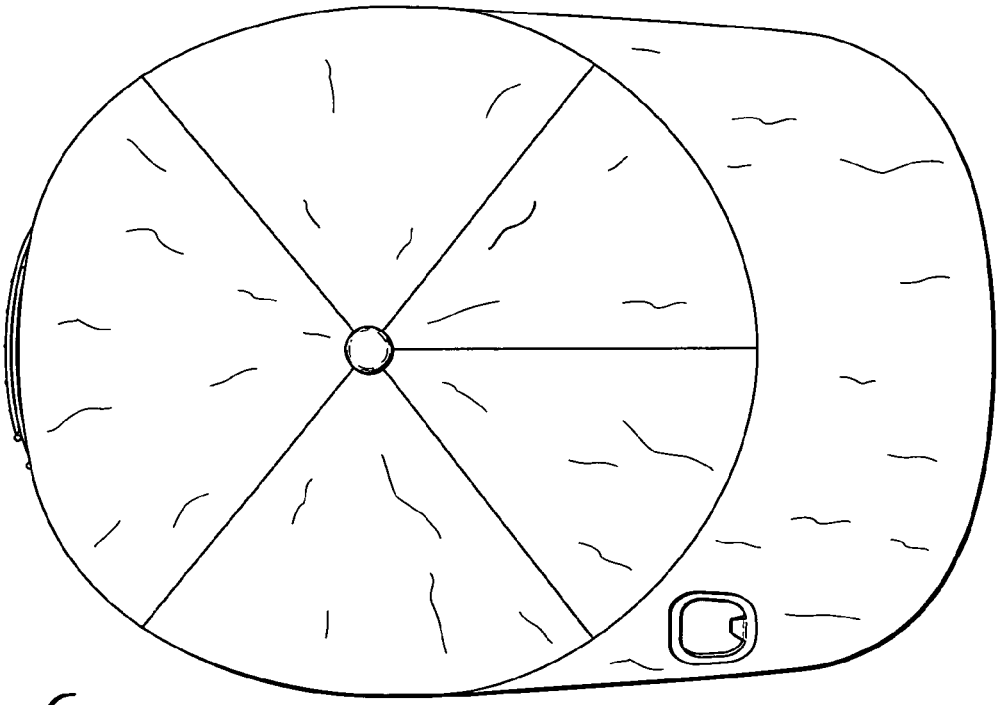
FIG. 6 is a top plan view of the headgear article of FIG. 1.
Figure 7:
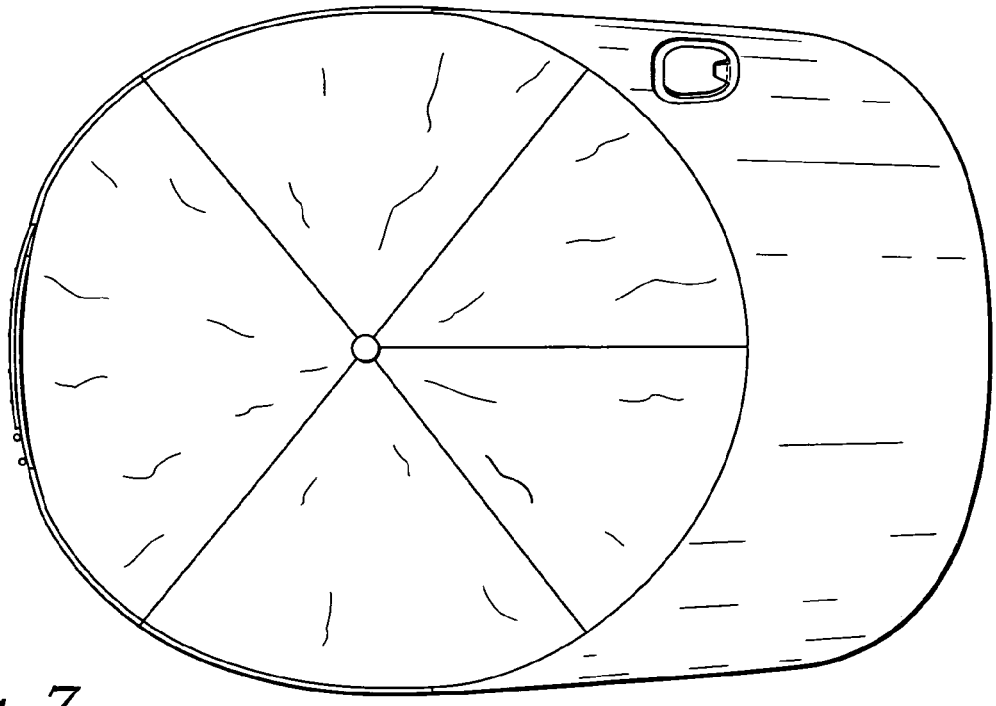
FIG. 7 is a top plan view of the headgear article of FIG. 1 wherein the bottle opener is positioned on a left side of the brim.

FIG. 4 is a right side elevation view of the cap 10 of FIG. 1, and FIG. 5 is a left side elevation view of the cap 10 of FIG. 1. FIG. 6 is a top plan view of the cap 10 of FIG. 1, and FIG. 7 is a top plan view of the cap 10 of FIG. 1 wherein the bottle opener 18 is positioned on a left side of the visor 16.

Figure 8:
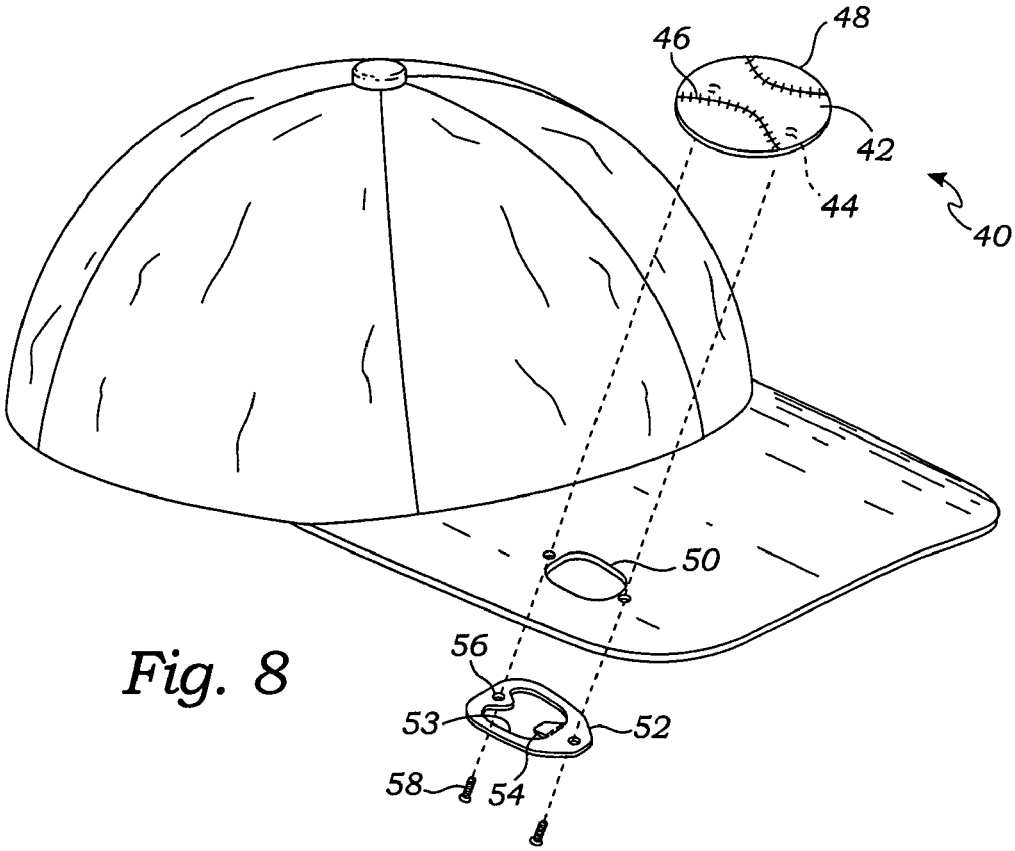
FIG. 8 is an exploded perspective view of a second embodiment of the headgear article.

FIG. 8 is an exploded perspective view of a second embodiment of the headgear article 10. In this embodiment, the headgear article 10 includes an alternative bottle opener 40 that includes a top plate 42 having fastener receivers 44. The top plate 42 may be printed with indicia 46 to resemble an article of sports equipment, in this case, a baseball. The top plate 42 preferably also includes a shaped perimeter 48 that corresponds with the sports equipment.

The bottle opener 40 further includes a bottle opener insert 52 that fits around an aperture 50 in the headgear article 10. The bottle opener insert 52 includes a tab 54 that is adapted for removing a bottle cap from a bottle.

The bottle opener insert 52 preferably includes an inner perimeter 53, and the tab 54 extends inwardly from the inner perimeter 53. The bottle opener insert 52 also includes a pair of fastener apertures 56 that are adapted to receive a pair of fasteners 58 such that each of the pair of fasteners 58 fits through one of the pair of fastener apertures 56, through the headgear article 10, and into the fastener receivers 44. Obviously, while two are shown herein, other numbers could also be used. Furthermore, other forms of fasteners, and different. arrangements of the fasteners, could be adapted by those skilled in the art, and such alternatives should be considered within the scope of the invention as claimed.

Figure 9:
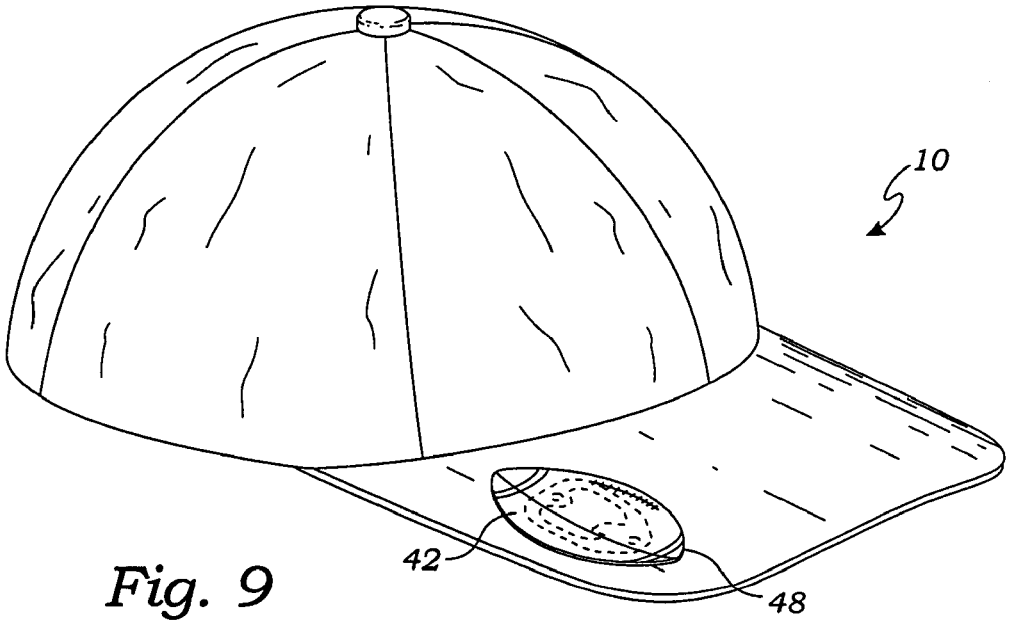
FIG. 9 is a perspective view of a third embodiment thereof.

As shown in FIG. 9, the top plate 42 of the bottle opener 40 can be formed into alternative shapes. The shaped perimeter 48 may be shaped like a football, for example, as shown. Other shapes and designs can be devised by those skilled in the art, and should be considered within the scope of the claimed invention.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A headgear article, comprising:

a head-engaging portion;

a brim attached to the head-engaging portion;

an opening in the brim;

a top plate and a bottle opener insert attached together with fasteners, the bottle opener insert having an aperture having an inner perimeter dimensioned to receive a portion of a bottle cap, the aperture being positioned over the opening in the brim such that the brim is sandwiched between said plate and said insert;

a tab extending from the bottle opener insert into the aperture, the tab being adapted to engage a rim of the bottle cap when the portion of the bottle cap is positioned in the aperture.

2. The headgear article as recited in claim 1, wherein the top plate includes a shaped perimeter adapted to resemble an article of sports equipment.

* * * * *